United States Patent [19]

Máhig

[11] 3,953,003

[45] Apr. 27, 1976

[54] TANK PROVIDED WITH PNEUMATIC MIXING PIPE

[75] Inventor: László Máhig, Budapest XIV, Hungary

[73] Assignee: Aluterv Aluminiumipari Tervezo Vallalat, Budapest XIII, Hungary

[22] Filed: June 6, 1974

[21] Appl. No.: 477,551

[52] U.S. Cl. ..... 259/4 R; 259/DIG. 17; 261/DIG. 75; 261/77

[51] Int. Cl.[2] ..... B01F 13/02

[58] Field of Search ..... 259/4, 18, 36, 95, DIG. 17; 261/77, DIG. 75

[56] References Cited

UNITED STATES PATENTS

| | | | |
|---|---|---|---|
| 2,292,897 | 8/1942 | Nielsen | 259/4 |
| 2,884,231 | 4/1959 | Pyle | 259/4 |
| 3,647,188 | 3/1972 | Solt | 259/DIG. 17 |
| 3,756,569 | 9/1973 | Wohlfarth | 259/4 |
| 3,807,705 | 4/1974 | Humkey | 259/DIG. 17 |

*Primary Examiner*—Robert W. Jenkins
*Attorney, Agent, or Firm*—Ladas, Parry, Von Gehr, Goldsmith & Deschamps

[57] ABSTRACT

A container adapted to thoroughly mix fluid material, especially suspensions, comprising a tank provided with a vertical mixing pipe, a vertical air lifting pipe, a gas collecting chamber located at the upper end of the mixing pipe, and a connecting pipe affixed at one end to the collecting chamber and communicating therewith and affixed at its other end to the bottom of the air lifting pipe and communicating therewith.

3 Claims, 3 Drawing Figures

TANK PROVIDED WITH PNEUMATIC MIXING PIPE

In large tanks, pneumatic mixing pipe (mammoth pump) is commonly used for mixing the materials to be treated, that is a gas — generally air — of higher pressure than the hydrostatic pressure of the material — generally liquid — to be treated is conducted to the lower part of the pipe of generally circular section (mixing pipe) installed in the tank. The gas bubbles rising upwards in the mixing pipe carry up also the material to be treated and the mixing is produced in this manner. Sometimes several tanks provided with mixing pipe are connected in series.

In case of series-connected tanks, the material to be treated — very often a slurry — is fed to the first tank and, being constantly mixed, is led through the tank series, and discharged from the last tank.

Several solutions are applied to carry the material to be treated from one tank to the other.

One solution is tank series arranged with level differences, that is stepwise, in which the material to be treated flows simply from one tank to the following. Its disadvantage is, however, that due to the necessary level differences, either tanks of different heights shall be used, or tanks of the same size shall be located stepwise. If, the material to be treated is a slurry, the solid concentration of the slurry flowing into the next tank is lower than the average solids concentration in the tank. In case of a stepwise arrangement, operating difficulties may arise too.

In another solution, the material to be treated, lifted up in the mixing pipe is conducted to a through-flow channel in which the flowing quantity can be controlled by a control device or by the offtakes situated on the bottom of the through-flow channel. With this solution, however, the entire quantity of the material to be treated shall be lifted up to the static height from which part it flows to the next tank. The lifting-up to this height of the part not flowing further means a surplus power consumption.

The solids concentration of the slurry discharged from the mixing pipe is much more higher than the solids concentration in the tank, so that the solids concentration in the tank decreases.

In another solution the material to be treated is carried by means of a lift-over pipe situated independently of the mixing pipe. Since the lift-over pipe generally does not reach the bottom of the tank, it is expedient to use a gas of lower pressure to operate it; so that either two gases of different pressures are used, to operate both the mixing pipe and the lift-over pipe, or a gas of unnecessarily high pressure is used for the lift-over pipe to assure the transport of the required slurry quantity, a control device shall be installed, thus increasing the costs.

It occurs often that in the various phases of the technological process, mixings of different or identical intensities shall be used expediently. In such cases the large-size tank — the use of which has economical advantages as against the use of several smaller tanks — should be expediently divided into several parts and the individual tank-parts should be mixed with different or identical intensities. This is the case in the "washing towers" where each tank-part means a washing phase too.

It occurs also that the lower part or parts of the tank divided into several parts shall be mixed only, since the upper part is used for other purposes, e.g. for settling, so that in this part of the tank the mixing would be technologically definitely disadvantageous. In tanks of such character the pneumatic mixing could not have been used up to now — although it would have been highly advantageous from the point of view of the tank dimensions — since mixing of the same intensity could not have been carried out in the tank parts located one above the other due to the variation of specific volume of the gas, or rather the removal of the gas from the lower tank parts could not be effected without the disturbance of the process in the upper tank parts.

The invention relates to a tank for mixing fluid material especially suspensions, e.g. when in alumina production the mixing of sodium aluminate liquor takes place. According to the invention said tank is provided with a pneumatically operating mixing pipe at the upper and of said mixing pipe a gas bell is arranged which is connected to the lower end of a lift over pipe by means of a gas pipe. Advantageously in said gase pipe a gas quantity control device is located.

In an other advantageous embodiment the tank for mixing fluid material, especially suspensions, is divided into three parts, the parts being arranged one above the other and the two lower parts are provided each with a pneumatically operated mixing pipe and at the upper end of the first mixing pipe a gas bell is arranged which is connected on the one hand to the second mixing pipe and on the other to the open space, while at the upper end of said second mixing pipe a second gas bell is arranged and connected to the open space and in the pipes leading to the open space gas quantity control devices are arranged.

In a further advantageous embodiment the tank is divided into several parts arranged one above the other and some of the parts are provided with a pneumatically operated mixing pipe at the upper and of which a gas bell is arranged, which is connected on the one hand to the mixing pipe of the subsequent tank and on the other hand to the open space while the gas bell arranged at the upper end of the last upper mixing pipe is connected to the open space and in each pipe leading to the open space a gas quantity control device is arranged.

The invention ensures a good mixing with a low specific energy, enables within a tank divided into several parts the realization of mixings at different or identical intensities, as well as the placing of tanks of the same height at the same level, ensures the conveying of the required quantity of material to be treated in a self-controlling manner, it may be operated with gas of the same pressure, and in case if the material to be treated is a slurry, it ensures the same solids concentration of the conveyed slurry and of the slurry in the tank.

The invention will be described more detailed with reference to the drawings.

Figure 1:
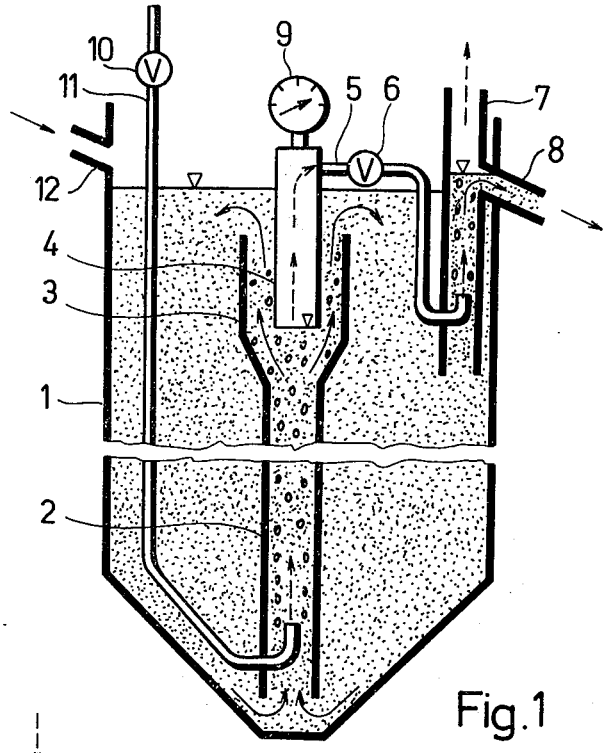
FIG. 1 shows the tank according to the invention in longitudinal section.

As it is seen in FIG. 1, in the tank 1 a mixing pipe 2 is installed, the upper end 3 of which is generally widened. Into or above the widened upper end 3 of the mixing pipe 2, enters a gas bell 4, to the upper part of which a gas pipe 5 is connected which is leading through a gas quantity control device 6 to the lower part of a liftover pipe 7. From the upper part of the lift-over pipe 7, exits an overflow pipe 8. The gas bell 4 is provided with a pressure gauge 9. A pipeline 11 provided with a control valve 10 supplies the operating gas, whereas a feed pipe 12 feeds the material to be treated. In the figures the gas flow direction is indicated with a dashedline arrow, whereas the flow-direction of the material to be treated with a continuous-line arrow.

For the transport of the material to be treated and for its mixing in the tank, a system is provided, the principle of operation of which is as follows:

The fluid material to be treated e.g. suspension is continuously fed into the tank 1 through the feed pipe 12. The gas supplied into the mixing pipe 2 through the control valve 10 and through the pipeline 11, respectively, lifts the material to be treated from the bottom of tank to the surface of the liquid and the entire quantity of gas or a part thereof is collected in the gas bell 4. The part of the gas used for mixing not entering the gas bell 4 bubbles sideway and participates further on the mixing operation. From the gas collected in the gas bell 4 the gas quantity required for the transport is supplied to the lift-over pipe 7 through the gas pipe 5 by adjusting the gas quantity control device 6. The gas quantity control device 6 shall be adjusted only once, thereafter it ensures in a self-controlling manner the transport of every required material, quantity, up to the adjusted maximum. The gas quantity in the gas bell 4, i.e. the degree of "saturation" of the gas bell 4, can be deduced from the indication of the pressure gauge 9.

Figure 2:
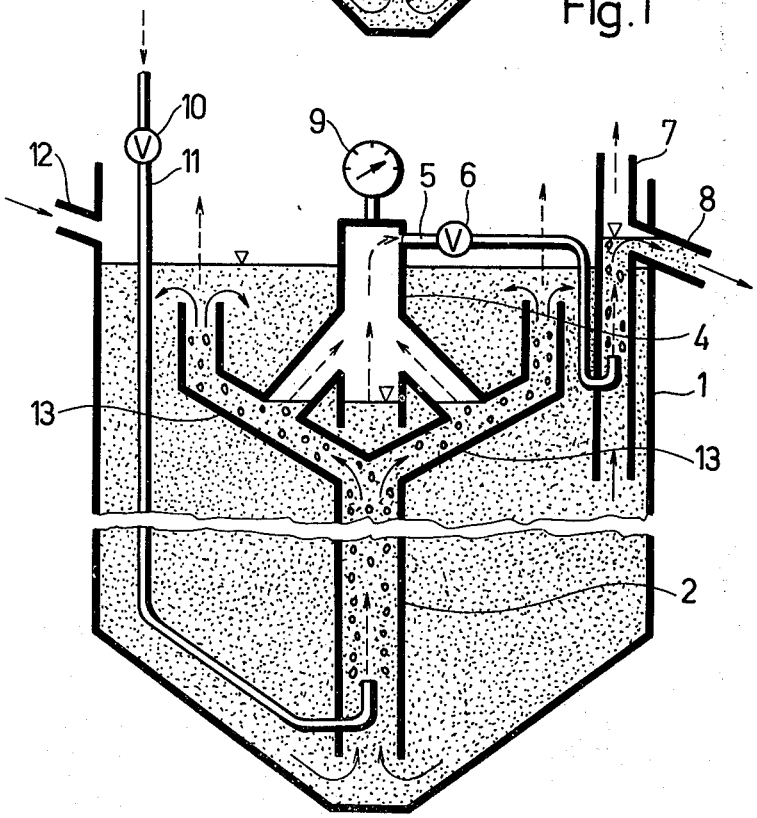
FIG. 2 shows the tank according to the invention provided with mixing pipe divided into several distribution pipe branches in longitudinal section.

FIG. 2 shows another realization of the tank according to the invention. in order to spread uniformly the material to be treated in the tank 1, the mixing pipe 2 is divided into several distribution pipe branches 13.

Figure 3:
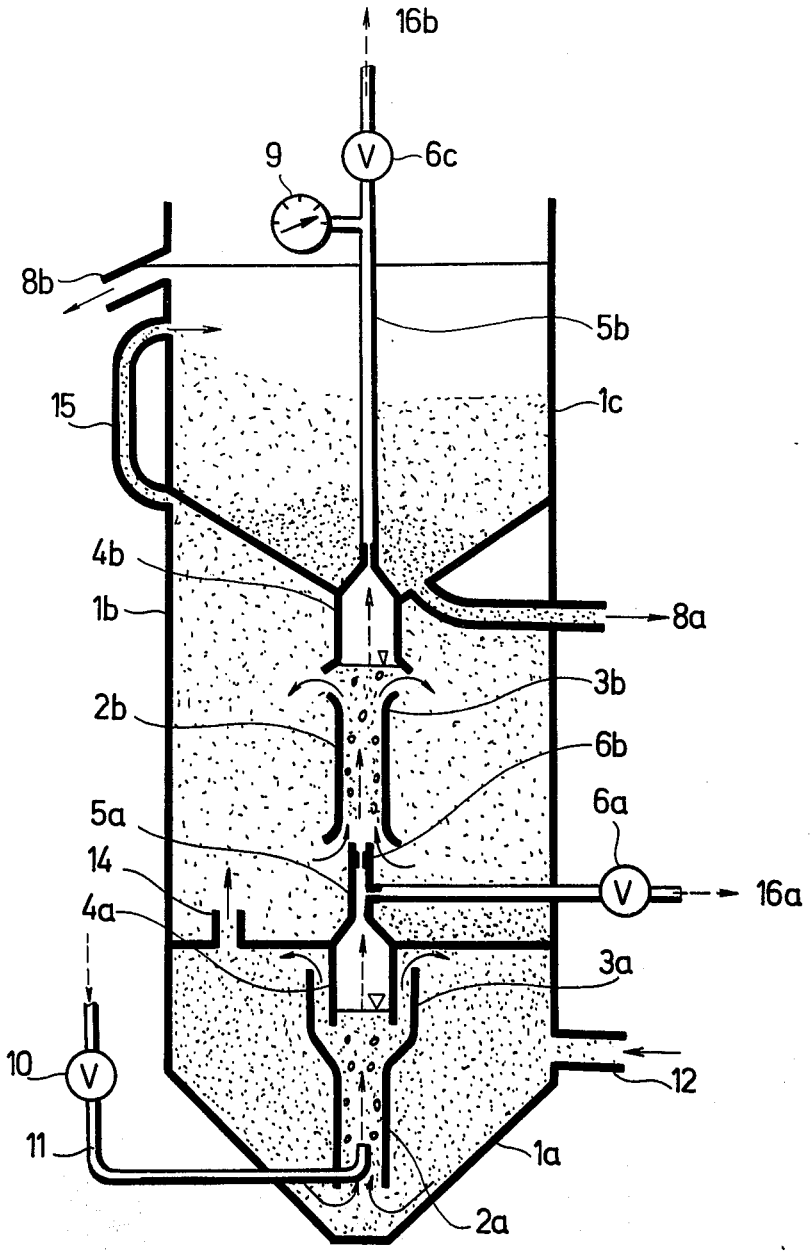
FIG. 3 shows the tank according to the invention divided into three parts, in longitudinal section.

FIG. 3 represents a tank according to the invention divided into several parts, where one part is arranged above the other. The gas supplied through the control valve 10 and pipeline 11 to cause flowing into mixing pipe 2*a* of the lower tank is part 1*a* of the tank divided, for instance, into three parts. A gas bell 4*a* enters into the widening upper end 3*a* of the mixing pipe 2*a*. *The gas bell 4a* can be also arranged above the upper end 3*a* of the mixing pipe. The quantity of gas collected in the gas bell 4*a* can flow through a gas pipe 5*a* and through gas quantity control devices 6*a* and 6*b* partly into the tank part 1*b*, and partly into the open space 16*a*.

The gas flowing through the gas quantity control device 6*a* mixes also the second tank part 1*b*, then, it is collected in a gas bell 4*b* installed above the upper end 4*b* of a mixing pipe 2*b*, wherefrom it flows through a gas pipe 2*b*, wherefrom it flow through a gas pipe 5*b* and a gas quantity control device 6*c* into the open space 16*b*. The pressure gauge 9 located on the gas pipe 5*b* indicates the degree of "saturation" of the gas bell 4*b*. The gas bell 4*b* can be arranged also into the widening upper end 3*b* of the mixing pipe 2*b*.

The fluid material to be treated i.e. suspension is fed through the feed pipe 12 into the tank part 1*a*, wherefrom it goes through an opening 14 into the tank part 1*b*. From here, it flows through a passage 15 into the tank part 1 which, in the illustrated embodiment, is not used as a mixer but as a settling chamber. Is the material to be treated a slurry, the settling occurs in the third tank part 1*c* and the part of the material to be treated, which is enriched in solids, is discharged from the tank through an underflow pipe 8*a*, whereas the clean overflow through a drain pipe 8*b*.

The principle of the operation is as follows:

The required intensity of the mixing in the tank part 1*a* is adjusted by means of gas quantity supplied through the control valve 10. The supplied gas is collected in the gas bell 4*a* and a part of this gas quantity is led into the open space 16*a* through the gas quantity control device 6*a*. The other part of the gas flows through the gas quantity control device 6*b* into the mixing pipe 2*b* and mixes the material to be treated, located in the tank part 1*b*. The suitable adjustment of the gas quantity control device 6*a* ensures the required intensity of mixing in the tank part 1*b*. If no gas is let out through the gas quantity control device 6*a* into the open space 16, the intensity of mixing in the tank part 1*b* will be higher than that in tank part 1*a*, due to the change of the specific volume of the gas. In the present case, the gas quantity control device 6*b* is developed as a throttling member.

The gas used for mixing of the tank part 1*b* is collected in the gas bell 4*b* and exhausts through the gas pipe 5*b* and gas quantity control device 6*c* into the open space, without, disturbing the flowing conditions of the tank part 1*c*.

The gas exhausting into the open spaces 16*a* and 16*b* can be, of course, utilized for the operation of lift-over pipes or further mixing pipes, if the applied mechanical design and the technology render it possible.

What we claim is:

1. A tank for mixing fluid material, especially suspensions comprising a tank provided with a vertical mixing pipe, a vertical air lifting pipe, a gas collecting chamber located at the upper end of said mixing pipe, and a connecting pipe affixed at one end to said collecting chamber and communicating therewith and affixed at its other end to the bottom of said air lifting pipe and communicating therewith.

2. The tank of claim 1, wherein there is located in said connecting pipe, a gas volume control device.

3. The tank of claim 1, wherein it is divided into several parts, and arranged in a stacked relationship with at least two parts provided with the vertical mixing pipe at the upper end of which there is situated a gas collecting bell-shaped chamber arranged with the upper end of the lower parts connected to the vertical mixing pipe of the subsquent higher part while the gas collecting chamber is arranged at the upper end of the upper-most part in the stack with the vertical mixing pipe connected to open space and a gas volume control device arranged in each pipe leading to such open space.

* * * * *